US009289791B2

(12) United States Patent
Uematsu et al.

(10) Patent No.: US 9,289,791 B2
(45) Date of Patent: Mar. 22, 2016

(54) PAINTING ROBOT SYSTEM AND SPRAY GUN UNIT

(71) Applicant: Toshiba Kikai Kabushiki Kaisha, Tokyo-to (JP)

(72) Inventors: Teppei Uematsu, Shizuoka-ken (JP); Yuji Negishi, Shizuoka-ken (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 357 days.

(21) Appl. No.: 13/675,857

(22) Filed: Nov. 13, 2012

(65) Prior Publication Data

US 2013/0134236 A1 May 30, 2013

(30) Foreign Application Priority Data

Nov. 14, 2011 (JP) ..... 2011-249031

(51) Int. Cl.

| | |
|---|---|
| ***B05C 5/02*** | (2006.01) |
| ***B05B 15/08*** | (2006.01) |
| ***B05B 13/04*** | (2006.01) |
| *B05C 15/00* | (2006.01) |

(52) U.S. Cl.

CPC ..... *B05B 15/08* (2013.01); *B05B 13/0431* (2013.01); *B05C 5/0216* (2013.01); *B05C 5/0295* (2013.01); *B05C 15/00* (2013.01)

(58) Field of Classification Search

None

See application file for complete search history.

(56) References Cited

U.S. PATENT DOCUMENTS

| | | | | |
|---|---|---|---|---|
| 4,613,082 | A * | 9/1986 | Gimple et al. | 239/690 |
| 5,090,361 | A | 2/1992 | Ishibashi et al. | |
| 5,103,761 | A * | 4/1992 | Ishibashi et al. | 118/323 |
| 5,163,370 | A | 11/1992 | Platsch | |
| 2010/0291310 | A1 * | 11/2010 | Hartmann et al. | 427/427.3 |

FOREIGN PATENT DOCUMENTS

| | | |
|---|---|---|
| CN | 1472013 | 2/2004 |
| JP | H04-501388 | 3/1992 |
| JP | 07-037355 | 7/1995 |
| JP | 10-192750 | 7/1998 |
| JP | 2004-033887 | 2/2004 |
| JP | 2010-120148 | 6/2010 |
| JP | 2011-025392 | 2/2011 |

OTHER PUBLICATIONS

Korean Office Action issued in KR 10-2012-128273 on Feb. 10, 2014.

(Continued)

*Primary Examiner* — Dah-Wei D Yuan
*Assistant Examiner* — Jethro M Pence
(74) *Attorney, Agent, or Firm* — DLA Piper LLP (US)

(57) ABSTRACT

A painting robot system includes a robot and a spray gun unit. The robot includes a plurality of robot arms and a drive shaft member disposed on a distal end robot arm of the multiple robot arms, the drive shaft member being rotatable about a distal end drive axis. The spray gun unit is mounted on the robot arm. The spray gun unit includes a support member fixed to the distal end robot arm, guide members disposed on the support member, a plurality of spray guns disposed on the support member, and a linkage mechanism connecting between the movable spray guns and the drive shaft member. A spacing between at least one pair of adjacent spray guns can be varied via the linkage mechanism by rotating the drive shaft member of the robot.

8 Claims, 8 Drawing Sheets

(56) References Cited

OTHER PUBLICATIONS

English Language Translation of Korean Office Action issued in KR 10-2012-128273 on Feb. 10, 2014.
English Language Abstract and Translation of JP 10-192750 published on Jul. 28, 1998.
English Language Abstract of JP 07-037355 published on Jul. 11, 1995.
English Language Tranlsation of JP 07-037355 published on Jul. 11, 1995.
English Language Abstract of JP 2010-120148 published Jun. 3, 2010.
English Language Translation of JP 2010-120148 published Jun. 3, 2010.
Chinese Office Action issued in CN 201210455050.X mailed Oct. 30, 2014 with Translation.
Japanese Office Action issued in JP 2011-249031 dated May 29, 2015 with English Language Translation.
English Language Abstract and Translation for JP 2004-033887 published Feb. 5, 2004.
English Language Abstract and Translation for JP 2011-025392 published Feb. 10, 2011.
Chinese Office Action issued in CN 201210455050.X mailed Jul. 1, 2015 with Translation.
English Language Abstract for CN 1472013 published Feb. 4, 2004.

* cited by examiner

PAINTING ROBOT SYSTEM AND SPRAY GUN UNIT

CROSS-REFERENCE TO RELATED APPLICATION

This application claims the benefit of Japanese Patent Application No. 2011-249031, filed on Nov. 14, 2011, which is incorporated herein by reference.

BACKGROUND OF THE INVENTION

1. Field of the Invention

The present invention relates to a painting robot system, and a spray gun unit incorporated in such a painting robot system.

2. Description of the Related Art

Known approaches to painting an article to be painted, such as a compact portable terminal, employ a robot for painting the article to be painted that is set up in a rotary jig. Others include a plurality of spray guns attached to a robot arm to achieve enhanced painting efficiency (see JP-A-2010-120148).

SUMMARY OF THE INVENTION

In the known common painting systems, however, a predetermined spacing (pitch) is established between the articles to be painted. As a result, when the spacing between the articles to be painted is changed, the paint job needs to be interrupted to thereby remove the spray gun unit from the robot and replace the spray gun unit with another set up for a different spray gun spacing. If a paint job involves a change in the spacing between the articles to be painted, therefore, a plurality of spray gun units, each having a unique spacing between spray guns, needs to be prepared in advance. This requires a lot of time for setup changes, including the replacement of the spray gun units. Another problem involved is increased cost for the preparation of the multiple types of spray gun units.

The present invention has been made in view of the foregoing and it is an object of the present invention to provide a painting robot system and a spray gun unit that allows a spacing between spray guns to be changed easily.

An aspect of the present invention provides a painting robot system comprising: a robot including a plurality of robot arms, each being rotatable about a corresponding drive axis, and a drive shaft member disposed on a distal end robot arm of the multiple robot arms, the drive shaft member being rotatable about a distal end drive axis; and a spray gun unit disposed on the distal end robot arm. The spray gun unit includes: a support member fixed to the distal end robot arm; a guide member disposed on the support member; a plurality of spray guns disposed on the support member, the spray guns including at least one movable spray gun movable along the guide member; and a linkage mechanism connecting between the movable spray gun and the drive shaft member. In the painting robot system, a spacing between at least one pair of adjacent spray guns can be varied via the linkage mechanism by rotating the drive shaft member of the robot.

In the aspect of the present invention, the spray guns include a fixed spray gun fixed to the support member.

In the aspect of the present invention, the fixed spray gun is disposed on a plane perpendicular to the guide member among planes in which the distal end drive axis exists.

In the aspect of the present invention, the linkage mechanism includes a drive link connected to the drive shaft member of the robot and a driven link rotatably connected to the drive link and to the movable spray gun.

In the aspect of the present invention, the support member has a through hole through which the drive shaft member passes.

In the aspect of the present invention, the movable spray gun includes a first movable spray gun disposed on one side of the fixed spray gun and a second movable spray gun disposed on a side opposite to the first movable spray gun relative to the fixed spray gun.

In the aspect of the present invention, a spacing between the first movable spray gun and the fixed spray gun and a spacing between the fixed spray gun and the second movable spray gun are identical to each other at all times.

In the aspect of the present invention, the spacing between at least one pair of adjacent spray guns of the multiple spray guns is varied according to an amount of rotation of the drive shaft member.

In the aspect of the present invention, the spray gun has a direction of paint application inclined relative to a surface of the support member.

Another aspect of the present invention provides a spray gun unit for use in the painting robot system, comprising: a support member to be fixed to the distal end robot arm; a guide member disposed on the support member; a plurality of spray guns disposed on the support member, the spray guns including at least one movable spray gun movable along the guide member; and a linkage mechanism connecting between the movable spray gun and the drive shaft member. In the spray gun unit, a spacing between at least one pair of the spray guns can be varied via the linkage mechanism by rotating the drive shaft member of the robot.

In the present invention, the rotation of the drive shaft member of the robot allows the spacing between at least one pair of the adjacent spray guns to be changed through the linkage mechanism. Cost involved in changing the spacing between a pair of articles to be painted can thus be reduced, while time required for setup can be shortened when the spacing between the pair of articles to be painted is to be changed.

BRIEF DESCRIPTION OF THE DRAWINGS

The present invention will be described hereinafter with reference to the accompanying drawings, wherein.

DETAILED DESCRIPTION OF THE PREFERRED EMBODIMENTS

A painting robot system according to a preferred embodiment of the present invention will be described below with reference to FIGS. 1 to 14. FIGS. 1 to 14 show a painting robot system according to the preferred embodiment of the present invention.

Figure 1:
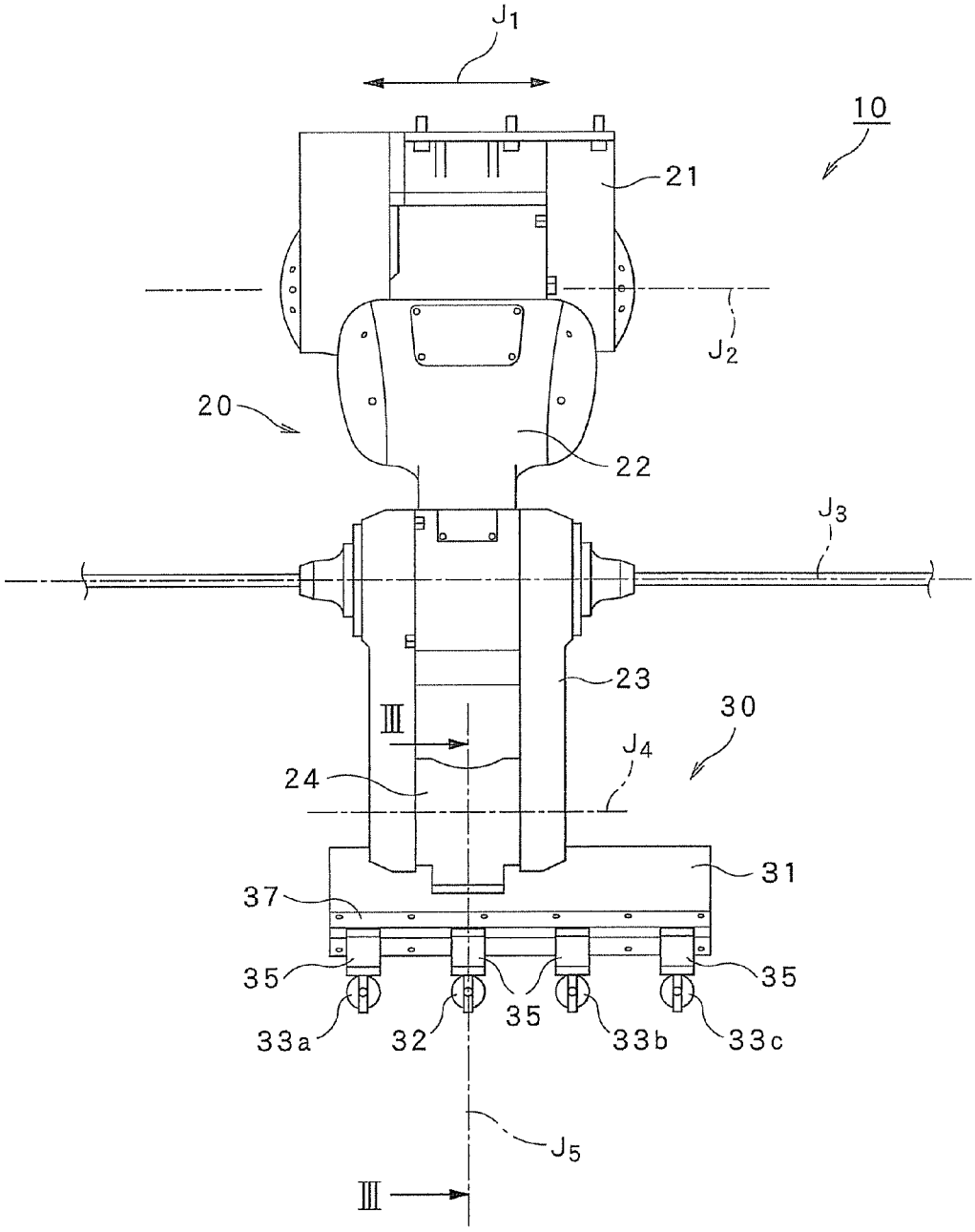
FIG. 1 is a front elevational view showing a painting robot system according to a preferred embodiment of the present invention.
Figure 2:
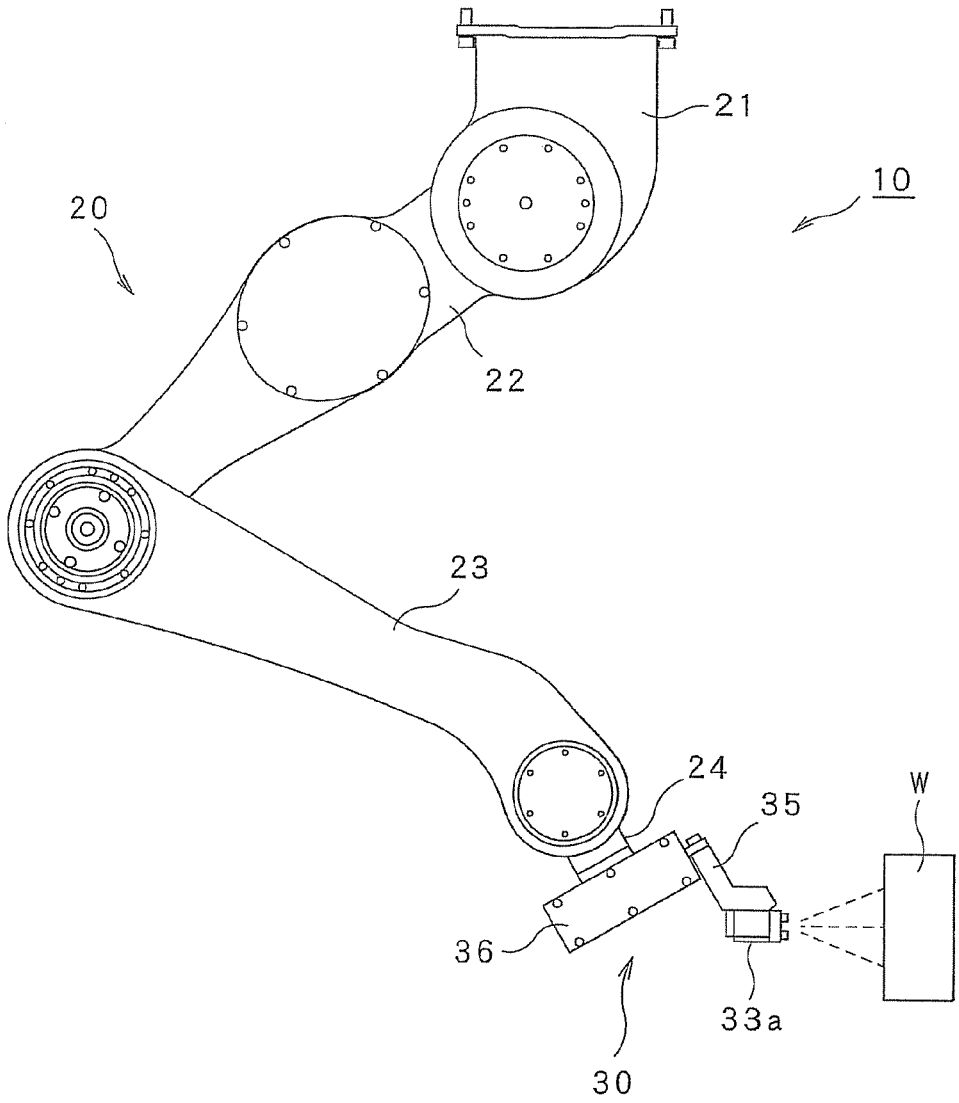
FIG. 2 is a side elevational view showing the painting robot system according to the preferred embodiment of the present invention.
Figure 3:
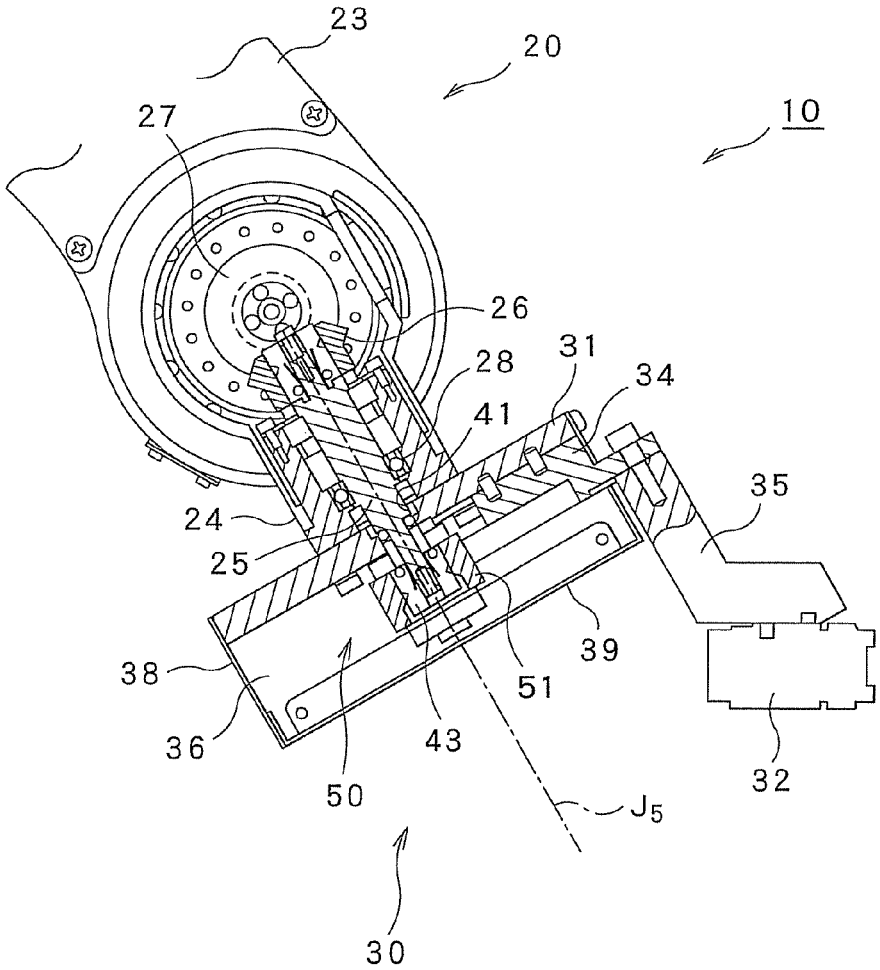
FIG. 3 is an enlarged cross-sectional view (taken along line III-III of FIG. 1) showing the painting robot system according to the preferred embodiment of the present invention.
Figure 4:
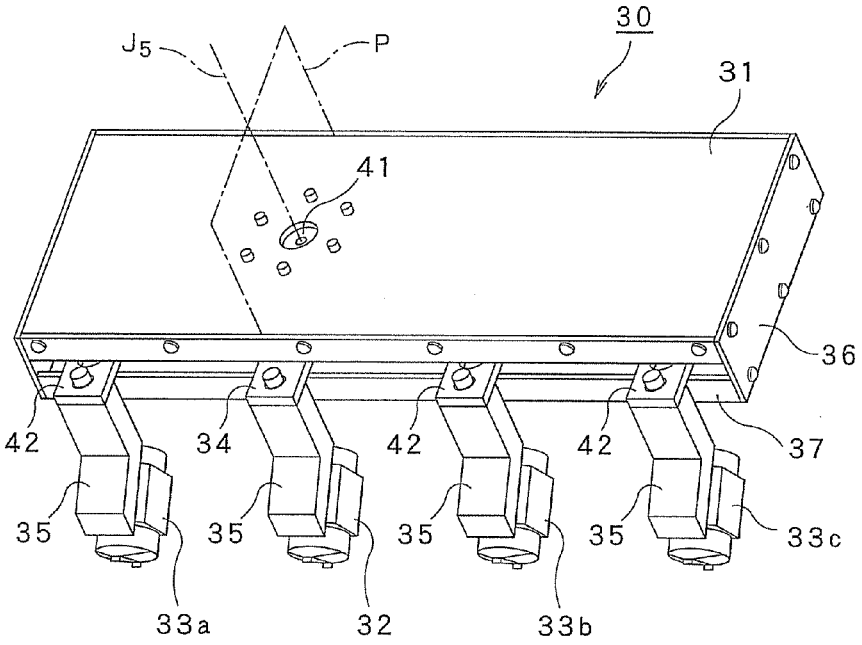
FIG. 4 is a perspective view showing a spray gun unit according to a preferred embodiment of the present invention.

General arrangements of the painting robot system according to the preferred embodiment of the present invention will be described below with reference to FIGS. 1 to 3. FIGS. 1 to 3 show the painting robot system according to the preferred embodiment of the present invention.

Referring to FIGS. 1 and 2, a painting robot system 10 includes a robot 20 and a spray gun unit 30. The robot 20 includes a base section 21 and a plurality of robot arms 22 to 24. The spray gun unit 30 is attached to the robot arm (a third robot arm) 24 at a distal end of the robot 20.

The robot 20 includes the base section 21 that is horizontally movable along a first drive axis $J_1$ and the three robot arms (a first robot arm 22, a second robot arm 23, and the third robot arm 24).

Relating to the three robot arms, the first robot arm 22 is rotatable relative to the base section 21 about a second drive axis $J_2$ that extends in parallel with the first drive axis $J_1$. The second robot arm 23 is rotatable relative to the first robot arm 22 about a third drive axis $J_3$ that extends in parallel with the second drive axis $J_2$. The third robot arm 24 is rotatable relative to the second robot arm 23 about a fourth drive axis $J_4$ that extends in parallel with the third drive axis $J_3$.

Referring to FIG. 3, the third robot arm 24 includes a drive shaft member 25 that is rotatable relative to the third robot arm 24 about a fifth drive axis $J_5$ (a distal end drive axis). The fifth drive axis $J_5$ is disposed perpendicularly to the fourth drive axis $J_4$. The drive shaft member 25 has a distal end protruding from a distal end of the third robot arm 24. The drive shaft member 25 has a distal end portion mounted on a linkage mechanism 50 of the spray gun unit 30 to be described later. The drive shaft member 25 has a proximal end portion in which a bevel gear 26 is fixed. The bevel gear 26 is in mesh with a bevel gear 27 on the side of the second robot arm 23. This arrangement is to change the direction of rotation 90 degrees when power from a motor, not shown, disposed on a proximal end side of the robot 20 is transmitted to the drive shaft member 25. The bevel gears 26, 27 may have straight or spiral teeth. It is noted that a bearing 28 that supports rotation of the drive shaft member 25 is disposed inside the third robot arm 24.

The robot 20 is otherwise arranged in substantially the same manner as in common robots (e.g. a vertical articulated robot) and detailed descriptions therefor will be omitted.

Arrangements of the spray gun unit according to the preferred embodiment of the present invention will be described below with reference to FIGS. 1 to 10. FIGS. 4 to 10 show the spray gun unit according to the preferred embodiment of the present invention.

Referring to FIGS. 1 to 10, the spray gun unit 30 includes a support member (base plate) 31, two guide members 40*a*, 40*b*, and a plurality of spray guns 32, 33*a* to 33*c*. Specifically, the support member 31 is fixed to the third robot arm 24. The guide members 40*a*, 40*b* are disposed on the support member 31. The spray guns 32, 33*a* to 33*c* are disposed on the support member 31.

The support member 31 is formed into a rectangular flat plate. The support member 31 further has a circular through hole 41 through which the drive shaft member 25 passes when the spray gun unit 30 is mounted on the third robot arm 24 (see FIGS. 4 and 6).

Additionally, the support member 31 is mounted with a side surface plate 36, a front surface plate 37, and a rear surface plate 38, each having a rectangular shape. The side surface plate 36, the front surface plate 37, and the rear surface plate 38 are mounted with a rectangular bottom surface plate 39. The support member 31, the side surface plate 36, the front surface plate 37, the rear surface plate 38, and the bottom surface plate 39 constitute a casing having substantially a cuboid shape. It is noted that FIG. 5 does not show the bottom surface plate 39 (the same holds true of FIGS. 12 and 14) and FIGS. 7, 9, and 10 do not show the side surface plate 36, the front surface plate 37, the rear surface plate 38, and the bottom surface plate 39.

Each of the guide members 40*a*, 40*b* is a linear motion guide fixedly connected to the bottom surface of the support member 31. The guide member 40*a* (hereinafter referred to also as a first guide member 40*a*) includes a rail 44*a* and a block 45*a* that moves horizontally along the rail 44*a*, constituting a relatively short linear motion guide. The other guide member 40*b* (hereinafter referred to also as a second guide member 40*b*) includes a rail 44*b* and blocks 45*b*, 45*c* that move horizontally along the rail 44*b*, constituting a relatively long linear motion guide. The first guide member 40*a* and the second guide member 40*b* are disposed, spaced apart from each other, along an identical straight line. This allows a fastening part 43 to be described later to be disposed between the first guide member 40*a* and the second guide member 40*b*. Additionally, the fifth drive axis $J_5$ crosses a straight line connecting between the rail 44*a* and the rail 44*b*.

Of the spray guns 32, 33*a* to 33*c*, the spray gun 32 (hereinafter referred to also as a fixed spray gun 32) is fixedly connected to the support member 31 via a fixing bracket 34 and a gun mounting member 35. Specifically, the fixed spray gun 32 is not movable relative to the support member 31. It is noted that the gun mounting member 35 has a dogleg-shaped cross section (FIG. 10), so that the fixed spray gun 32 has a direction of paint application inclined relative to a surface of the support member 31.

When viewed from the front side (see FIG. 7), the fixed spray gun 32 is disposed on the same position as the fifth drive axis $J_5$ that rotates the drive shaft member 25. To state the foregoing differently, the fixed spray gun 32 is disposed on, of planes in which the fifth drive axis $J_5$ exists, a plane P (see FIGS. 4 and 6) perpendicular to the guide members 40*a*, 40*b*. The foregoing arrangement allows the fixed spray gun 32 to be fixedly disposed on the fifth drive axis $J_5$, which is the rotation center of the drive shaft member 25, as viewed from the front side.

In contrast, each of the spray guns 33*a* to 33*c* (hereinafter referred to also as a first movable spray gun 33*a*, a second movable spray gun 33*b*, and a third movable spray gun 33*c*) is movable relative to the support member 31. Of the spray guns 33*a* to 33*c*, the first movable spray gun 33*a* is mounted on the block 45*a* of the first guide member 40*a* via an elongated bracket 42. This results in the first movable spray gun 33*a* being guided along the rail 44*a* of the first guide member 40*a* and linearly movable in the horizontal direction along the rail 44*a*.

The second movable spray gun 33*b* and the third movable spray gun 33*c* are mounted on the block 45*b* and the block 45*c*, respectively, of the second guide member 40*b* via elongated brackets 42. The second movable spray gun 33*b* and the third movable spray gun 33*c* are guided along the rail 44*b* of the second guide member 40*b* and linearly movable along the rail 44*b*.

In this case, the first movable spray gun 33*a* is disposed on a first side (on the left side in FIG. 7) relative to the fixed spray gun 32 and the second movable spray gun 33*b* and the third movable spray gun 33*c* are disposed on the side opposite to the first side (on the right side in FIG. 7) relative to the fixed spray gun 32.

At least one hose not shown is connected to the fixed spray gun 32 and the movable spray guns 33*a* to 33*c*. Paint or air is supplied through the hose to thereby allow paint to be sprayed to a workpiece (article to be painted) W (see FIG. 2). The fixed spray gun 32 and the movable spray guns 33*a* to 33*c* may be formed of commonly used spray guns. In the preferred embodiment of the present invention, the fixed spray gun 32 and the movable spray guns 33*a* to 33*c* have an identical configuration, which, however, is not the only possible arrangement and each of the fixed spray gun 32 and the movable spray guns 33*a* to 33*c* may have a unique configuration that is different from each other.

Referring to FIG. 3, the drive shaft member 25 is connected to the linkage mechanism 50 via the fastening part 43. The linkage mechanism 50 is also connected to the movable spray guns 33*a* to 33*c*. Rotation of the drive shaft member 25 of the robot 20 moves the movable spray guns 33*a* to 33*c* via the fastening part 43 and the linkage mechanism 50.

Figure 5:
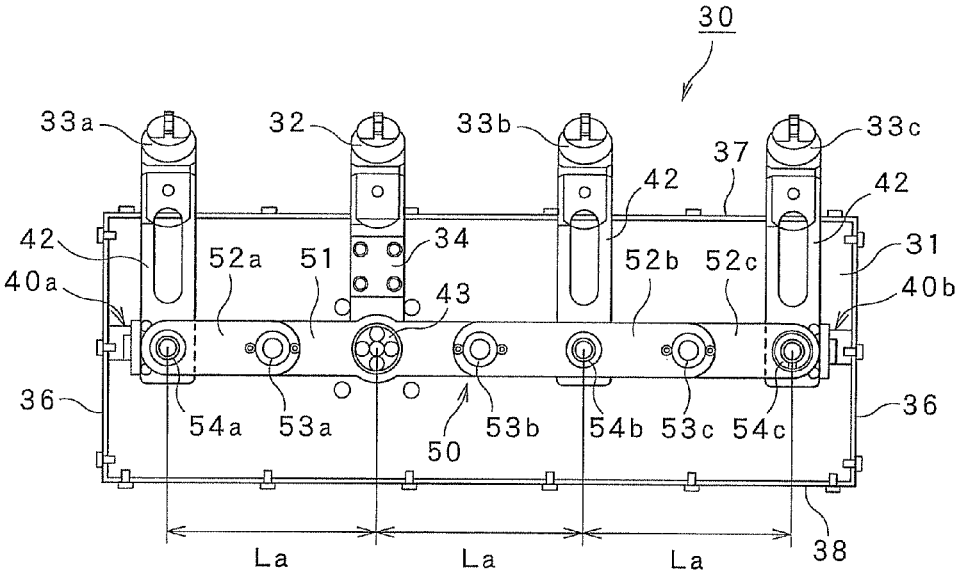
FIG. 5 is a bottom plan view showing the spray gun unit according to the preferred embodiment of the present invention.
Figure 6:
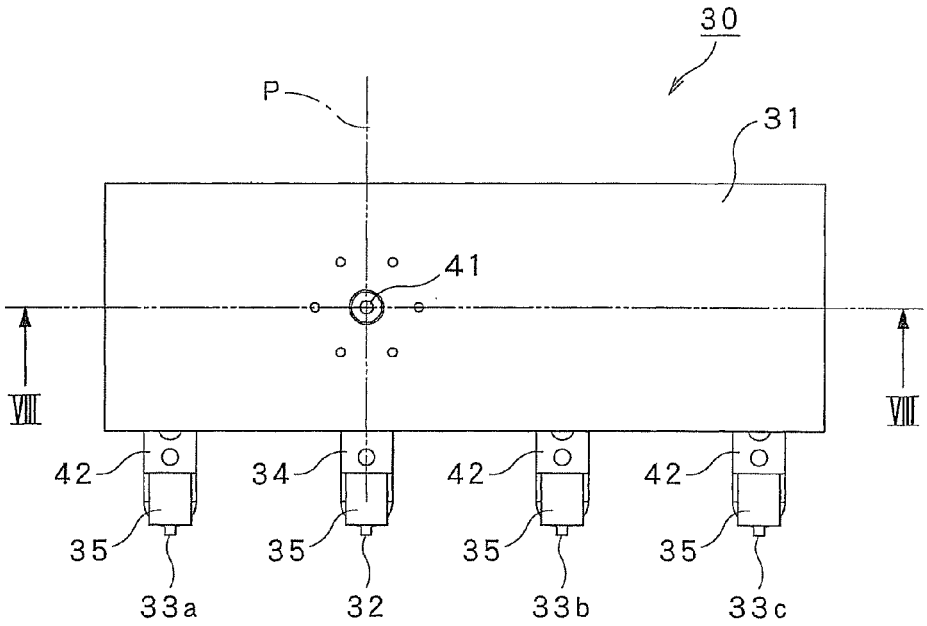
FIG. 6 is a plan view showing the spray gun unit according to the preferred embodiment of the present invention.
Figure 7:
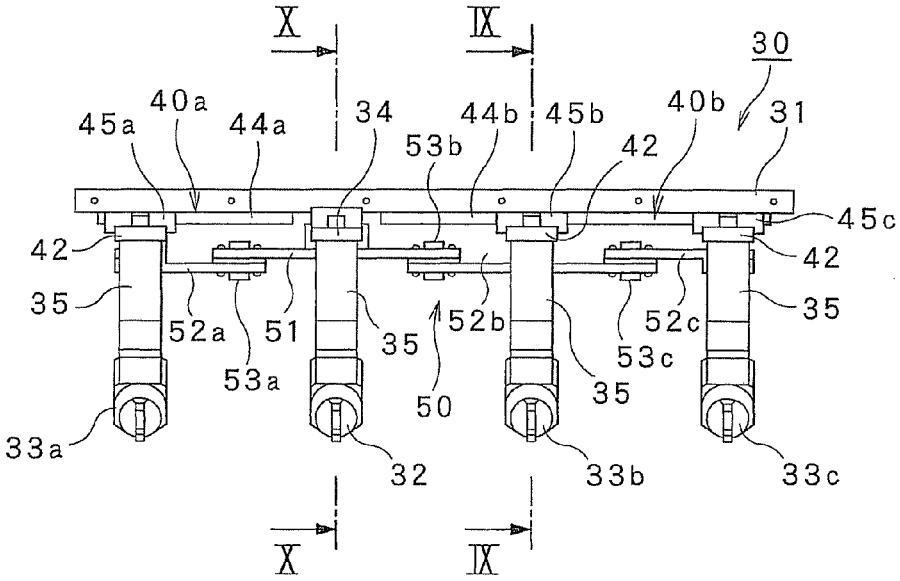
FIG. 7 is a front elevational view showing the spray gun unit according to the preferred embodiment of the present invention.
Figure 8:
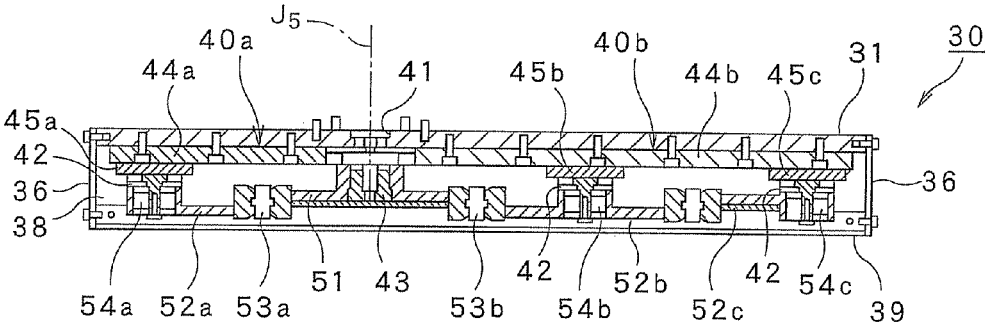
FIG. 8 is a cross-sectional view (taken along line VIII-VIII of FIG. 6) showing the spray gun unit according to the preferred embodiment of the present invention.
Figure 9:
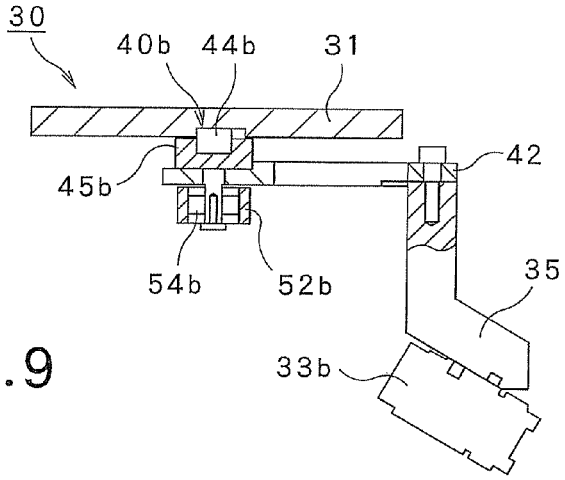
FIG. 9 is a cross-sectional view (taken along line IX-IX of FIG. 7) showing the spray gun unit according to the preferred embodiment of the present invention.
Figure 10:
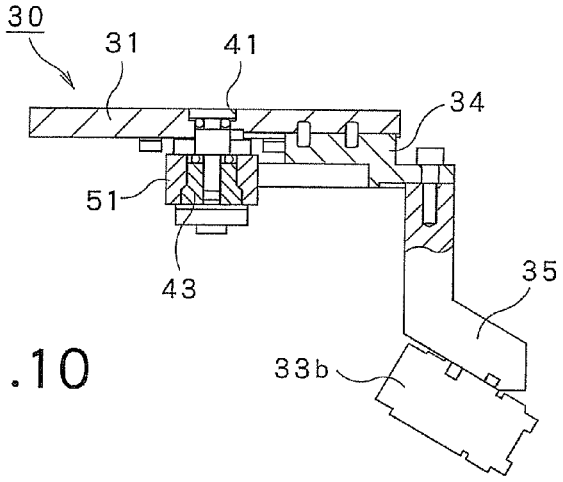
FIG. 10 is a cross-sectional view (taken along line X-X of FIG. 7) showing the spray gun unit according to the preferred embodiment of the present invention.

Specifically, referring to FIGS. 5, 7, and 8, the linkage mechanism 50 includes a drive link 51 and driven links 52*a* to 52*c* (hereinafter referred to also as a first driven link 52*a*, a second driven link 52*b*, and a third driven link 52*c*). The drive link 51 is connected to the drive shaft member 25 of the robot 20 via the fastening part 43 at a central portion thereof.

The first driven link 52*a* has one end rotatably connected to the drive link 51 via a shaft member 53*a* and the other end rotatably connected to the first movable spray gun 33*a* via a shaft member 54*a*. The second driven link 52*b* has an end rotatably connected to the drive link 51 via a shaft member 53*b* and a central portion rotatably connected to the second movable spray gun 33*b* via a shaft member 54*b*. The third driven link 52*c* has one end rotatably connected to the second driven link 52*b* via a shaft member 53*c* and the other end rotatably connected to the third movable spray gun 33*c* via a shaft member 54*c*.

It is noted that each of the drive link 51 and the driven links 52*a* to 52*c* has an elongated flat plate shape. The drive link 51 and the second driven link 52*b* have a substantially identical length and the first driven link 52*a* and the third driven link 52*c* have a substantially identical length. In addition, the drive link 51 and the second driven link 52*b* have a length about twice as long as the first driven link 52*a* and the third driven link 52*c*.

Having the linkage mechanism 50 with the arrangements as described above allows, relative to the fixed spray gun 32 and the movable spray guns 33*a* to 33*c*, the spacing between each pair of adjacent spray guns to be varied. In this case, the fixed spray gun 32 and the movable spray guns 33*a* to 33*c* are disposed so as to allow an identical spacing (pitch) away from each other at all times. Specifically, referring to FIG. 5, a spacing La between the first movable spray gun 33*a* and the fixed spray gun 32, a spacing La between the fixed spray gun 32 and the second movable spray gun 33*b*, and a spacing La between the second movable spray gun 33*b* and the third movable spray gun 33*c* are all identical to each other. Further, the linkage mechanism 50 ensures that the spacing between the first movable spray gun 33*a* and the fixed spray gun 32, the spacing between the fixed spray gun 32 and the second movable spray gun 33*b*, and the spacing between the second movable spray gun 33*b* and the third movable spray gun 33*c* are all identical to each other wherever the movable spray guns 33*a* to 33*c* are located (see FIGS. 11 to 14 to be described later).

It is noted that, in FIGS. 4 to 10, the drive link 51 and the driven links 52*a* to 52*c* of the linkage mechanism 50 are disposed along a straight line and, relative to the fixed spray gun 32 and the movable spray guns 33*a* to 33*c*, the spacing (La) between each pair of adjacent spray guns is the maximum.

Operation of the preferred embodiment of the present invention having the arrangements as described heretofore will be described below with reference to FIGS. 4 to 14. In particular, operation will be described when, relative to the fixed spray gun 32 and the movable spray guns 33*a* to 33*c*, the spacing between each pair of adjacent spray guns is to be changed.

Assume, for example, a paint job in which the painting robot system 10 paints a plurality of workpieces W (FIG. 2) arrayed with the spacing (La) allowed between each pair of the workpieces W. In this case, relative to the fixed spray gun 32 and the movable spray guns 33*a* to 33*c*, the spacing (La) between each pair of adjacent spray guns is the maximum (see FIGS. 4 to 10). Under this condition, the robot 20 is operated and the workpieces W are painted using the fixed spray gun 32 and the movable spray guns 33*a* to 33*c*.

Next, operation will be described, in a case where a paint job is performed when a plurality of workpieces W arrayed with a spacing Lb that is narrower than the spacing La allowed between each pair of the workpieces W is to be painted. In this case, the drive shaft member 25 of the robot 20 is rotated to thereby narrow, relative to the fixed spray gun 32 and the movable spray guns 33*a* to 33*c*, the spacing between each pair of adjacent spray guns through the linkage mechanism 50.

At this time, power from the motor, not shown, disposed on a proximal end side of the robot 20 is transmitted to the drive shaft member 25 via the bevel gear 27 and the bevel gear 26 in sequence. This rotates the drive shaft member 25 in a predetermined direction (a clockwise direction in FIG. 12).

Figure 12:
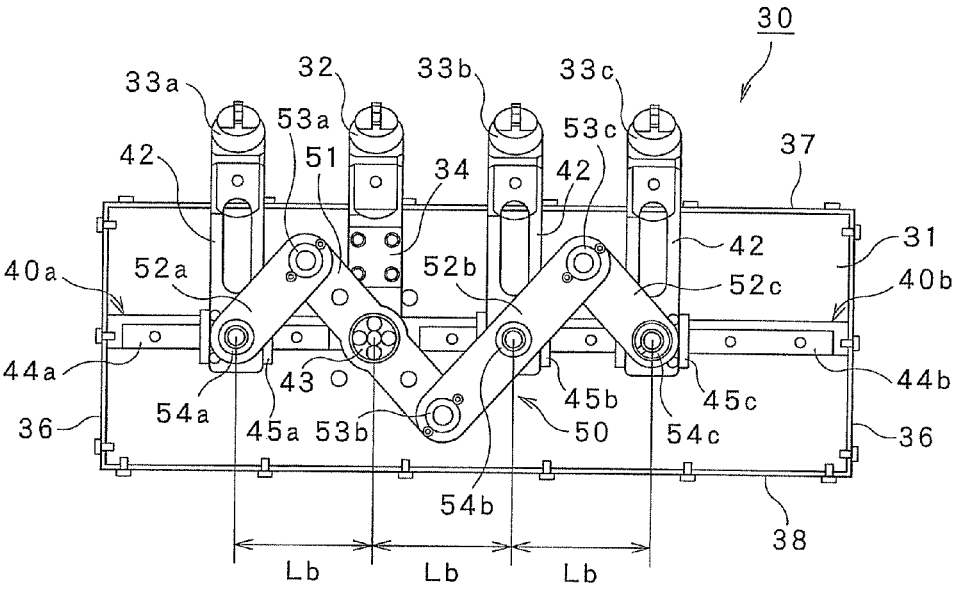
FIG. 12 is a bottom plan view showing a condition of the spray gun unit according to the preferred embodiment of the present invention in which the spacing between each pair of adjacent spray guns is shortened.

The rotation of the drive shaft member 25 rotates the fastening part 43 in the same direction as the drive shaft member 25 (in the clockwise direction in FIG. 12), which results in the drive link 51 of the linkage mechanism 50 being rotated about the fastening part 43 in a predetermined direction (in the clockwise direction in FIG. 12). The rotation of the drive link 51 changes an angle of each of the driven links 52*a* to 52*c*, so that distances among the spray guns 32 and 33*a* to 33*c* connected to the respective driven links 52*a* to 52*c* are changed.

Specifically, being operatively connected with the drive link 51, the first driven link 52*a* is rotated in a direction opposite to the direction in which the drive link 51 rotates (in the counterclockwise direction in FIG. 12). This causes the first movable spray gun 33*a* to be guided by the first guide member 40*a* via the bracket 42 and the shaft member 54*a* and moved horizontally in a direction of approaching the fixed spray gun 32.

Similarly, being operatively connected with the drive link 51, the second driven link 52*b* is rotated in a direction opposite to the direction in which the drive link 51 rotates (in the counterclockwise direction in FIG. 12). This causes the second movable spray gun 33*b* to be guided by the second guide member 40*b* via the bracket 42 and the shaft member 54*b* and moved horizontally in a direction of approaching the fixed spray gun 32.

Being operatively connected with the second driven link 52*b*, the third driven link 52*c* is rotated in a direction opposite to the direction in which the second driven link 52*b* rotates (in the clockwise direction in FIG. 12). This causes the third movable spray gun 33*c* to be guided by the second guide member 40*b* via the bracket 42 and the shaft member 54*c* and moved horizontally in a direction of approaching the second movable spray gun 33*b*. Meanwhile, the fixed spray gun 32 is fixed relative to the support member 31.

Figure 11:
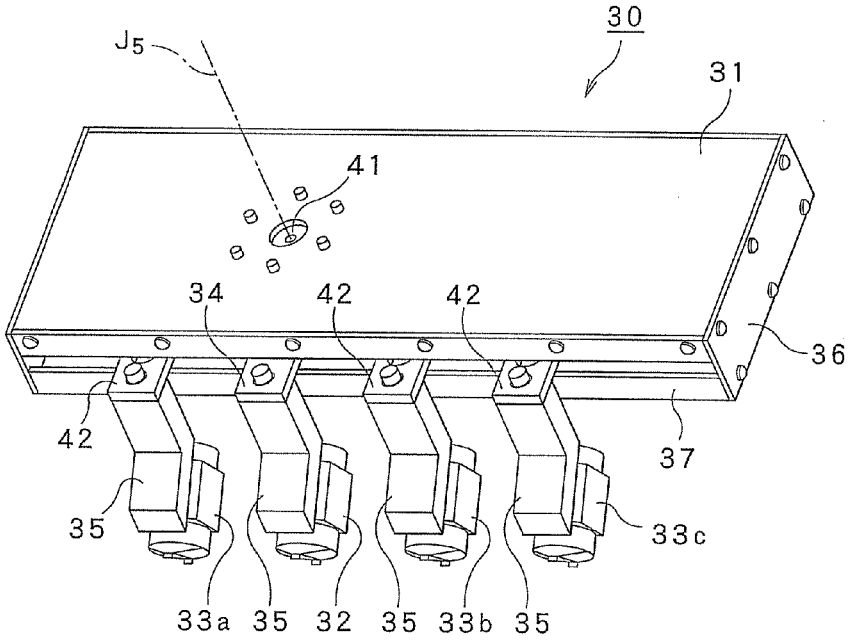
FIG. 11 is a perspective view showing a condition of the spray gun unit according to the preferred embodiment of the present invention in which a spacing between each pair of adjacent spray guns is shortened.

In the foregoing manner, the fixed spray gun 32 and the movable spray guns 33*a* to 33*c* are brought to respective positions with the identical spacing Lb (<La) allowed between each pair of the adjacent spray guns (FIGS. 11 and 12). Specifically, in FIGS. 11 and 12, the spacing Lb between the first movable spray gun 33*a* and the fixed spray gun 32, the spacing Lb between the fixed spray gun 32 and the second movable spray gun 33*b*, and the spacing Lb between the second movable spray gun 33*b* and the third movable spray gun 33*c* are all identical to each other.

Operation will then be described, in a case where a paint job is performed when a plurality of workpieces W arrayed with a spacing Lc that is even narrower than the spacing Lb allowed between each pair of the workpieces W is painted.

In this case, the drive shaft member 25 of the robot 20 further rotates to thereby further narrow, relative to the fixed spray gun 32 and the movable spray guns 33*a* to 33*c*, the spacing between each pair of the adjacent spray guns through the linkage mechanism 50.

Specifically, in the same manner as in the foregoing, further rotation of the drive shaft member 25 rotates the drive link 51 and the driven links 52*a* to 52*c* of the linkage mechanism 50 through the fastening part 43. This results in the movable spray guns 33*a* to 33*c* moving horizontally in a direction of further approaching the fixed spray gun 32.

Figure 13:
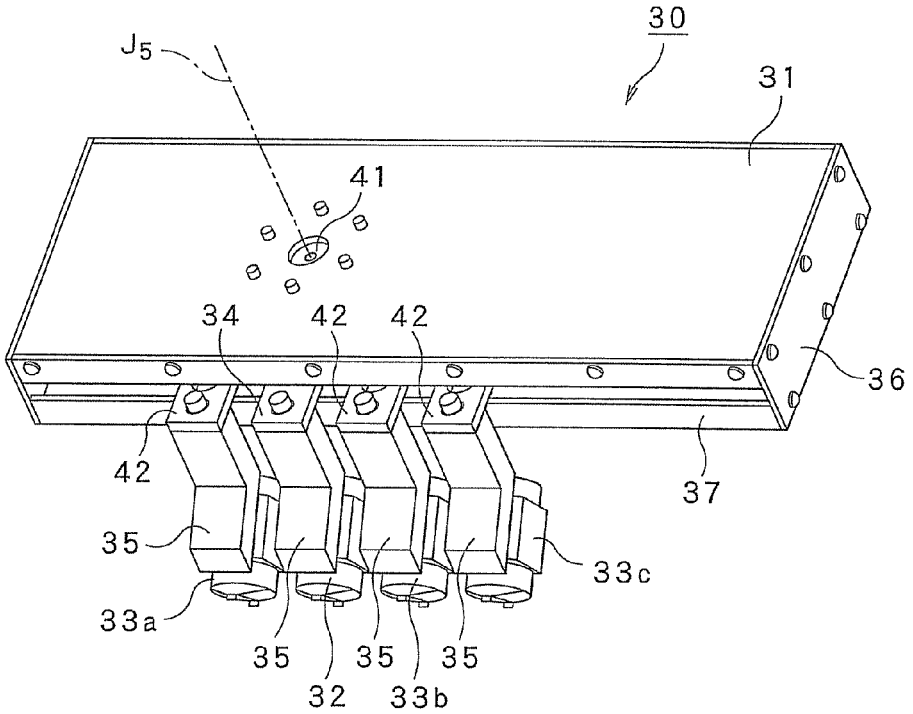
FIG. 13 is a perspective view showing a condition of the spray gun unit according to the preferred embodiment of the present invention in which the spacing between each pair of adjacent spray guns is a minimum.
Figure 14:
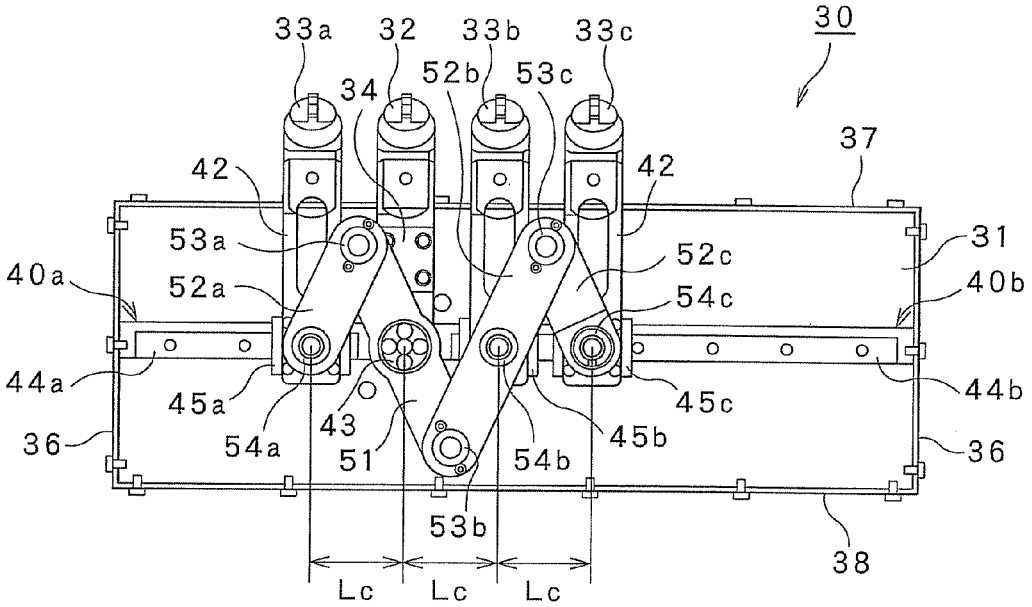
FIG. 14 is a bottom plan view showing a condition of the spray gun unit according to the preferred embodiment of the present invention in which the spacing between each pair of adjacent spray guns is the minimum.

In the foregoing manner, the fixed spray gun 32 and the movable spray guns 33*a* to 33*c* are brought to respective positions with the identical spacing Lc (<Lb) allowed between each pair of the adjacent spray guns (FIGS. 13 and 14). Specifically, in FIGS. 13 and 14, the spacing Lc between the first movable spray gun 33*a* and the fixed spray gun 32, the spacing Lc between the fixed spray gun 32 and the second movable spray gun 33*b*, and the spacing Lc between the second movable spray gun 33*b* and the third movable spray gun 33*c* are all identical to each other. It is noted that, in FIGS. 13 and 14, each of the movable spray guns 33*a* to 33*c* is the closest to the fixed spray gun 32 having a minimum spacing (Lc) between each pair of the adjacent spray guns of the fixed spray gun 32 and the movable spray guns 33*a* to 33*c*.

Performing an operation in a reverse way with respect to the foregoing allows the spacing between, relative to the fixed spray gun 32 and the movable spray guns 33*a* to 33*c*, each pair of the adjacent spray guns to be widened. Specifically, the drive shaft member 25 and the fastening part 43 are rotated in a direction opposite to the foregoing direction (specifically, in the counterclockwise direction in FIG. 14). This results in the movable spray guns 33*a* to 33*c* being guided by the guide members 40*a*, 40*b* and moved in a direction of being away from the fixed spray gun 32.

As described heretofore, in the preferred embodiment of the present invention, the rotation of the drive shaft member 25 of the robot 20 allows, relative to the spray guns 32 and 33*a* to 33*c*, the spacing between each pair of adjacent spray guns to be changed via the linkage mechanism 50. Specifically, the spacing between each pair of the adjacent spray guns 32 and 33*a* to 33*c* can be freely variable according to the amount of rotation of the drive shaft member 25. This allows, relative to the spray guns 32 and 33*a* to 33*c*, the spacing between each pair of the adjacent spray guns to be varied in many different ways using only the single spray gun unit 30. This eliminates the need for replacing the spray gun unit 30 with a new one in order to change the spacing between each pair of the workpieces W, thus shortening time required for the paint job. The foregoing also eliminates the need for preparing another spray gun unit 30 that is otherwise required when the spacing between each pair of the workpieces W is to be changed, achieving reduction in cost of the spray gun unit 30. Further, the linkage mechanism 50 as well as the drive shaft member 25 on the side of the robot 20 is utilized, which allows, relative to the spray guns 32 and 33*a* to 33*c*, the spacing between each pair of the adjacent spray guns to be changed freely using a minimal number of elements.

In the preferred embodiment of the present invention, the fixed spray gun 32 fixed to the support member 31 is disposed on, of the planes in which the distal end drive axis $J_5$ exists, the plane P perpendicular to the guide members 40*a*, 40*b*. Consequently, each of the movable spray guns 33*a* to 33*c* can be moved along the guide members 40*a*, 40*b* to thereby change its relative position freely, while the fixed spray gun 32 is held at a predetermined position relative to the support member 31.

In the preferred embodiment of the present invention, the linkage mechanism 50 includes the drive link 51 connected to the drive shaft member 25 and the driven links 52*a*, 52*b* rotatably connected to the drive link 51 and to the movable spray guns 33*a*, 33*b*. Relative to the spray guns 32 and 33*a* to 33*c*, the spacing between each pair of the adjacent spray guns can therefore be changed with a simple arrangement.

Additionally, in the preferred embodiment of the present invention, the support member 31 further has the through hole 41 through which the drive shaft member 25 passes. When the support member 31 is mounted on the third robot arm 24, therefore, the drive shaft member 25 can therefore be reliably connected to the linkage mechanism 50.

Additionally, in the preferred embodiment of the present invention, the movable spray guns 33*a* to 33*c* include the first movable spray gun 33*a* disposed on a first side of the fixed spray gun 32 and the second movable spray gun 33*b* disposed on the opposite side of the first movable spray gun 33*a* relative to the fixed spray gun 32. The first movable spray gun 33*a* and the second movable spray gun 33*b* can therefore be moved away from, or close to, the fixed spray gun 32 to thereby change their respective spacings from the fixed spray gun 32 freely.

Additionally, in the preferred embodiment of the present invention, the spacing between the first movable spray gun 33*a* and the fixed spray gun 32, the spacing between the fixed spray gun 32 and the second movable spray gun 33*b*, and the spacing between the second movable spray gun 33*b* and the third movable spray gun 33*c* are all identical to each other at all times. This allows the spray gun unit 30 to respond easily to variable spacings between each pair of workpieces W that are equally spaced apart from each other.

The preferred embodiment of the present invention incorporates one fixed spray gun 32 and three movable spray guns 33*a* to 33*c*. This is, however, not the only possible arrangement. Alternatively, for example, all spray guns may be movable and none fixed in position. Alternatively, two or more spray guns may be fixed in position. Still alternatively, the number of movable spray guns may be one, two, or four or more, instead of three.

Additionally, in the preferred embodiment of the present invention, the first movable spray gun 33*a* is disposed on one side of the fixed spray gun 32 and the second movable spray gun 33*b* and the third movable spray gun 33*c* are disposed on the other side of the fixed spray gun 32. This is, however, not the only possible arrangement. Alternatively, for example, all of the movable spray guns 33*a* to 33*c* may be disposed on the same side with each other relative to the fixed spray gun 32.

What is claimed is:

1. A painting robot system comprising:

a robot including a plurality of robot arms, each being configured to rotate about a corresponding drive axis, and a drive shaft member disposed on a distal end robot arm of the plurality of robot arms, the drive shaft member being configured to rotate about a distal end drive axis, the drive shaft member comprising a proximal end portion in which a first bevel gear is fixed, the first bevel gear being in mesh with a second bevel gear on a side of one of the plurality of robot arms so as to change a direction of rotation 90 degrees when power from a motor disposed on a proximal end side of the robot is transmitted to the drive shaft member; and a spray gun unit disposed on the distal end robot arm, the spray gun unit including:

a support member fixed to the distal end robot arm;

a guide member disposed on the support member;

a plurality of spray guns disposed on the support member, the spray guns including at least one movable spray gun configured to move along the guide member; and a linkage mechanism connecting between the movable spray gun and the drive shaft member, the linkage mechanism including:

a drive link having an elongated flat plate shape and connected to the drive shaft member of the robot; and a driven link having an elongated flat plate shape and connected to the drive link and to the moving spray gun;

wherein the driven link is configured to rotate with regard to the drive link and the moving spray gun; and wherein the linkage mechanism is configured to vary a spacing between at least one pair of adjacent spray guns by rotating the drive shaft member of the robot.

2. The painting robot system according to claim 1, wherein the spray guns include a fixed spray gun fixed to the support member.

3. The painting robot system according to claim 2, wherein the fixed spray gun is disposed on a plane perpendicular to the guide member among planes in which the distal end drive axis exists.

4. The painting robot system according to claim 1, wherein the support member comprises a through hole through which the drive shaft member passes.

5. The painting robot system according to claim 2, wherein the movable spray gun includes a first movable spray gun disposed on one side of the fixed spray gun and a second movable spray gun disposed on a side opposite to the first movable spray gun relative to the fixed spray gun.

6. The painting robot system according to claim 5, wherein a spacing between the first movable spray gun and the fixed spray gun and a spacing between the fixed spray gun and the second movable spray gun are identical to each other at all times.

7. The painting robot system according to claim 1, wherein the spacing between at least one pair of adjacent spray guns of the multiple spray guns is varied according to an amount of rotation of the drive shaft member.

8. The painting robot system according to claim 1, wherein the plurality of spray guns have a direction of paint application inclined relative to a surface of the support member.

* * * * *